US006383019B1

(12) United States Patent
Wild

(10) Patent No.: US 6,383,019 B1
(45) **Date of Patent: *May 7, 2002**

(54) CONNECTOR FOR A COAXIAL CABLE WITH SMOOTH OUTER CABLE CONDUCTOR

(75) Inventor: Werner Wild, Buttenwiesen-Unterthürheim (DE)

(73) Assignee: Spinner GmbH Elektrotechnische Fabrik, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/501,252

(22) Filed: Feb. 10, 2000

(30) Foreign Application Priority Data

Feb. 10, 1999 (DE) ..... 199 06 023

(51) Int. Cl.[7] ..... H01R 13/40
(52) U.S. Cl. ..... 439/578
(58) Field of Search ..... 439/578, 583, 439/584

(56) References Cited

U.S. PATENT DOCUMENTS 5,595,502 A * 1/1997 Allison ..... 439/583
5,766,037 A * 6/1998 Nelson ..... 439/583
5,993,254 A * 11/1999 Pitschi et al. ..... 439/584
6,032,358 A * 3/2000 Wild ..... 439/583

FOREIGN PATENT DOCUMENTS

DE 43 43 229 C2 12/1994

* cited by examiner

*Primary Examiner*—Renee Luebke
*Assistant Examiner*—Briggitte Hammond
(74) *Attorney, Agent, or Firm*—Henry M. Feiereisen

(57) ABSTRACT

A connector for attachment to a coaxial cable having a smooth outer cable conductor, includes a connector head having a threaded portion and defining a ring surface for establishing a contact from inside with an end zone of an outer cable conductor. The outer cable conductor is enclosed by a contact sleeve which has a plurality of radially resilient segments. Surrounding the contact sleeve is a hollow screw which is so threadably engageable with the connector head along a predetermined clamping path, until the end zone of the outer cable conductor is urged against the contact surface of the connector head. The contact sleeve, when not exposed to a load, has an inner diameter which in the area of the beaded ends of the segments is smaller than a diameter of the outwardly deflected end zone of the outer cable conductor and in the remaining area is greater than the diameter of the outwardly bent end zone of the outer cable conductor.

7 Claims, 3 Drawing Sheets

CONNECTOR FOR A COAXIAL CABLE WITH SMOOTH OUTER CABLE CONDUCTOR

CROSS-REFERENCES TO RELATED APPLICATIONS

This application claims the priority of German Patent Application Serial No. 199 06 023.1, filed Feb. 10, 1999, the subject matter of which is incorporated herein by reference.

BACKGROUND OF THE INVENTION

The present invention relates, in general, to a connector for a coaxial cable with smooth outer cable conductor, and more particularly to a connector of a type including a connector head having a recess for threaded engagement of a hollow screw which surrounds the cable.

The use of connectors for coaxial cables with a diameter of normally less than 10 mm and with smooth outer cable conductor in the form of either a braided metal foil or a braiding of numerous thin single wires is generally known. Normally, the inner cable conductor is soldered with the inner connector conductor retained in the connector head, whereas the outer cable conductor is folded back by a short piece at the end and clamped by the hollow screw inside the recess of the connector head.

Coaxial cables for commercial application, especially for transmitting greater power, typically have a massive, helically corrugated or annularly corrugated outer conductor to impart the cable with a certain flexibility, without encountering a deterioration of the electric properties. Connectors for these types of coaxial cables can be supplied from the factory completely pre-assembled and mounted to the end of the coaxial cable, without requiring a preceding dismantling thereof. Their use is in particular suitable in exposed sites of installation such as antenna masts or the like, because the installation can be executed in a time-saving manner and in a more secure fashion. An example of such a connector is described in German Pat. No. 43 43 229 C2.

Recently, coaxial cables for commercial application have been encountered which have a massive, smooth outer conductor and still exhibit sufficient flexibility. The use of conventional, pre-assembled connectors, as described above and employed for cables with corrugated outer conductor, is however unsuitable for coaxial cables with smooth outer conductor, because the installation is based on the principle of providing, i.a., a form-fitting engagement between components of the connector and the corrugated outer cable conductor.

SUMMARY OF THE INVENTION

It is thus an object of the present invention to provide an improved connector, obviating the afore-stated drawbacks.

In particular, it is an object of the present invention to provide an improved connector which can be mounted pre-assembled onto a coaxial cable with a smooth outer cable conductor, without requiring a preceding dismantling thereof.

These objects, and others which will become apparent hereinafter, are attained in accordance with the present invention by providing a connector head having a ring surface for establishing a contact from inside with an outwardly deflected end zone of an outer cable conductor; a contact sleeve adapted to fit over the outer cable conductor and having a plurality of radially resilient segments terminating in beaded ends, wherein the contact sleeve, when not subject to a load, has an inner diameter which in the area of the beaded ends of the segments is smaller than a diameter of the outwardly deflected end zone of the outer cable conductor and in the remaining area is greater than the diameter of the outwardly deflected end zone of the outer cable conductor; and a hollow screw adapted to fit over the contact sleeve and formed with a thread for threaded engagement with the connector head, wherein the hollow screw, after traveling a clamping path, loads the segments of the contact sleeve in a direction of a clamping action so that the segments clamp the end zone of the outer cable conductor against the ring surface of the connector head.

A connector according to the present invention can be installed to one end of the coaxial cable, without preceding dismantling thereof because the novel and inventive design of the pre-assembled connector allows the installer to simply slip the connector over the prepared cable end until reaching a tactile resistance. Subsequently, the installer needs only to rotate the hollow screw into the connector head until a specified torque has been reached, indicating a sufficiently tight clamping action of the outer cable conductor. Yet, the installer has the option to completely unscrew the hollow screw from the connector head for dismantling the connector, should such action become necessary for any reason.

Thus, the connector according to the present invention for attachment to a coaxial cable with smooth outer conductor has the same advantages as a pre-assembled and mounted connector for a coaxial cable with corrugated outer conductor.

According to another feature of the present invention, the connector is provided with an indexing mechanism for subdividing the clamping path of the threaded clamping bush into first and second sections, with the first section corresponding to a pre-assembled state of the connector, and with the second segment corresponding to a complete assembly of the connector onto the cable end. The provision of such an indexing mechanism enables an installer to correctly preassemble and reattach the connector to the coaxial cable, if for some reason, the connector has been previously completely disassembled.

The indexing mechanism for subdividing the clamping path of the hollow screw may be implemented by providing an O ring which is received in an annular groove so positioned that the O ring engages a confronting end face of the connector head at the end of the first section and is moved conjointly with the hollow screw when the hollow screw travels along the second clamping path section. This configuration of the indexing mechanism is especially easy to implement and thus cost-efficient. In addition, the O ring may also provide a seal between the connector head and the hollow screw.

According to another feature of the present invention, the hollow screw has an axial end, which confronts the connector head, and includes a portion extending axially inwardly of the annular groove at a length, which is at least equal to a length of the second section of the clamping path, and being defined by an outer diameter which is smaller than an inner diameter of the recess of the connector head.

The installation can be facilitated when providing the hollow screw interiorly with a radially inwardly projecting shoulder which forms a stop for a ring collar of the contact sleeve and so limits a displacement of the contact sleeve in the pre-assembled state of the connector that a gap is defined between the ring surface of the connector head and the segments of the contact sleeve for insertion of the end zone of the outer cable conductor. The inwardly directed shoulder of the hollow screw may assume even a further purpose, namely to transmit the thrust of the hollow screw onto the contact sleeve. Suitably, the shoulder is then configured as continuous or interrupted ring shoulder having a connector-proximal end face which transmits the clamping force at the end of the second clamping path section onto confronting surfaces of the beaded ends of the segments of the contact sleeve.

The beaded ends of the segments of the contact sleeve may define ramp surfaces respectively formed on a peripheral conical surface area for interaction with the end zone of the outer cable conductor, whereby the conical surface area defines a cone angle which is so selected that the segments deflect radially outwards when an axial force applied by the end of the outer cable conductor upon the ramp surfaces of the beaded ends is exceeded.

As the connection between the cable and the connector should, in general, comply with very high mechanical and electrical standards, as far as resistance against separation and intermodulation freedom are concerned, at least one of the surfaces, which realizes the clamping action of the end zone of the outer cable conductor, has at least one bead for improving the clamping action and contact-making capability.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
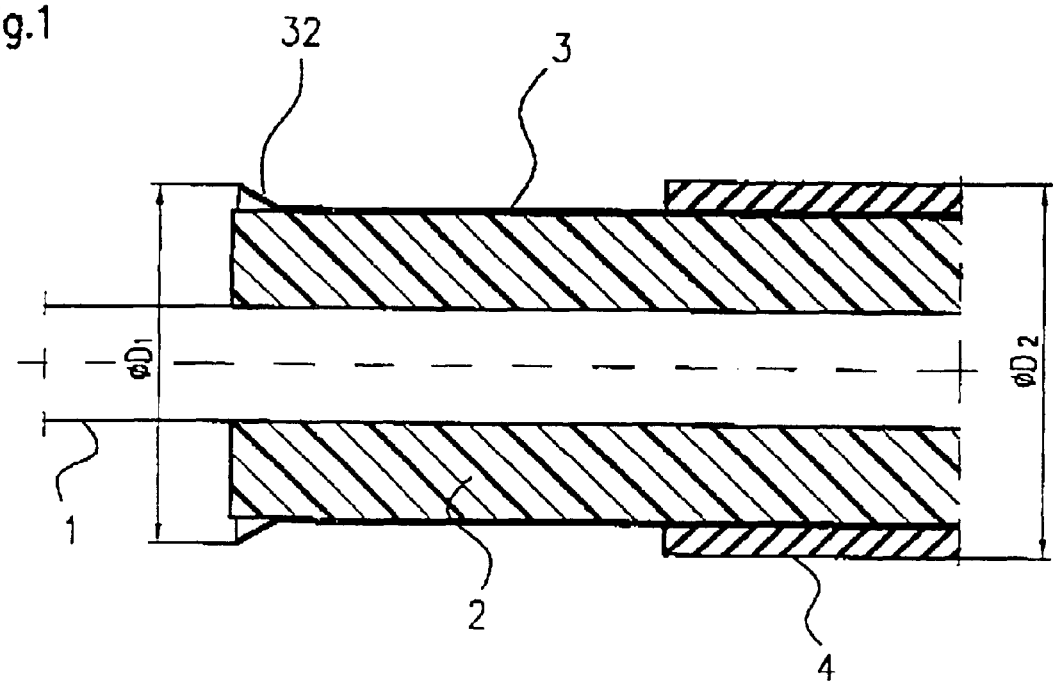
FIG. 1 is a longitudinal section of one end of a coaxial cable.

Throughout all the Figures, same or corresponding elements are generally indicated by same reference numerals.

Turning now to the drawing, and in particular to FIG. 1, there is shown a longitudinal section of one end of a coaxial cable of more current configuration. The cable includes a tubular inner cable conductor 1, which is centered in and supported by a dielectric 2, normally a foamed dielectric. Surrounding the dielectric 2 is a smooth outer conductor 3 which may be made of a copper alloy or aluminum alloy and is enclosed by a cable jacket 4 that has been trimmed away by a specified length in dependence on the connector design, so that a bare section of the outer conductor 3 projects beyond the cable jacket 4 by an appropriate length. The outer conductor 3 is formed with an end zone 32 which is deflected outwards, e.g. in conical shape, and defines a greatest diameter $D_1$. Persons skilled in the art will understand that the end zone may, instead, be flanged outwards at a right angle. Reference character $D_2$ denotes an outer diameter defined by the cable including the cable sheath 4. In the non-limiting example, involved here, the diameter $D_1$ is equal or smaller than the diameter $D_2$ because, as will be described in more detail furtherbelow, the cable sheath 4 projects into the connector, i.e. the connector should have at its cable-proximal end an inner diameter which is at least equal to the outer diameter $D_2$.

Figure 2:
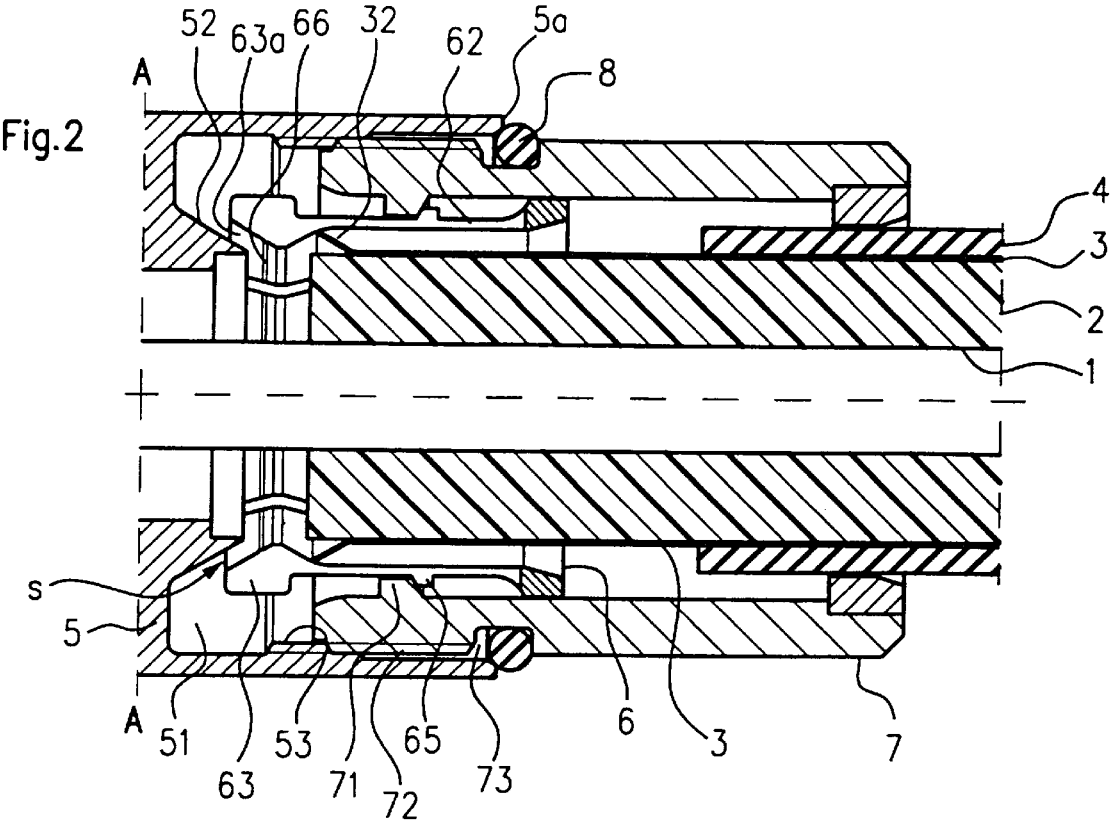
FIG. 2 is a sectional view of one embodiment of a connector for attachment to the coaxial cable of FIG. 1 in the pre-assembled stage.

Turning now to FIG. 2, there is shown a sectional view of one embodiment of a connector for attachment to the coaxial cable of FIG. 1 in the pre-assembled stage. The connector includes a connector head 5 which is shown here only by way of its cable-proximal end that is of relevance here as far as the present invention is concerned, i.e. the portion that is of interest as far as electric contacting and mechanical clamping of the outer cable conductor are concerned. For example, to the left of the broken line A—A, the connector head 5 may be configured in a conventional manner, depending on the respective application at hand, and may have an inner connector conductor (not shown) of any suitable configuration for electric and mechanical connection with the inner cable conductor 1. In particular, the connection of the inner connector conductor and the inner cable conductor 1 may be implemented in the form of a plug/socket configuration. This, however, is not part of the present invention and therefore not shown in the drawing for sake of simplicity.

On its cable-proximal end, the connector head 5 is formed with a recess 51 which is flanked by a beveled ring surface 52 and destined to accommodate a contact sleeve 6 which has a plurality of axial slits (not shown) extending from the connector head proximal end to form a plurality of resilient segments 62. Each segment 62 has a free end terminating in a bead 63. The contact sleeve 6 is inserted in a clamping bush in the form of a hollow screw 7 by pushing the resilient segments 62 together. The hollow screw 7 is formed externally with an external thread 72 which is followed axially inwardly by an annular groove 73 for receiving an O ring 8. The contact sleeve 6 is freely movable within the hollow screw 7 but held captive in the hollow screw 7 through provision of an inwardly projecting ring shoulder 71, which interacts with a ring collar 65 of the contact sleeve 6.

In the pre-assembly stage, the connector has been attached to the suitably prepared end of the cable, shown in FIG. 1, until a tactile resistance is realized when the axial end 31 of the end zone 32 of the outer cable conductor 3 impacts against a ramp surface **63*b* formed interiorly on the beaded ends 63 of the segments 62. In this position, the O ring 8 bears against a confronting end 5*a* of the connector head 5, whereas the external thread 72 of the hollow screw 7 meshes the first turns of an internal thread 53 in the recess 51 of the connector head 5, and the external ring collar 65 of the contact sleeve 6 rests against the radially inwardly projecting ring shoulder 71 of the hollow screw 7. In the pre-assembly stage, shown in FIG. 2, a gap s is defined between the beveled ring surface 52 at the bottom of the recess 51 of the connector head 5 and a confronting parallel beveled ring surface 63*a* at the inside of the beaded end 63 of the outer cable conductor 3. The beveled ring surface 63*a* is further formed with a circumferential bead 66 of few tenths of a millimeter height. After installation, the bead 66 slightly squeezes itself into the outside of the outwardly deflected end zone 32 of the outer cable conductor 3** to thereby enhance the mechanical clamping and electrical contacting. This is also useful for accomplishing a great intermodulation distance.

Figure 3:
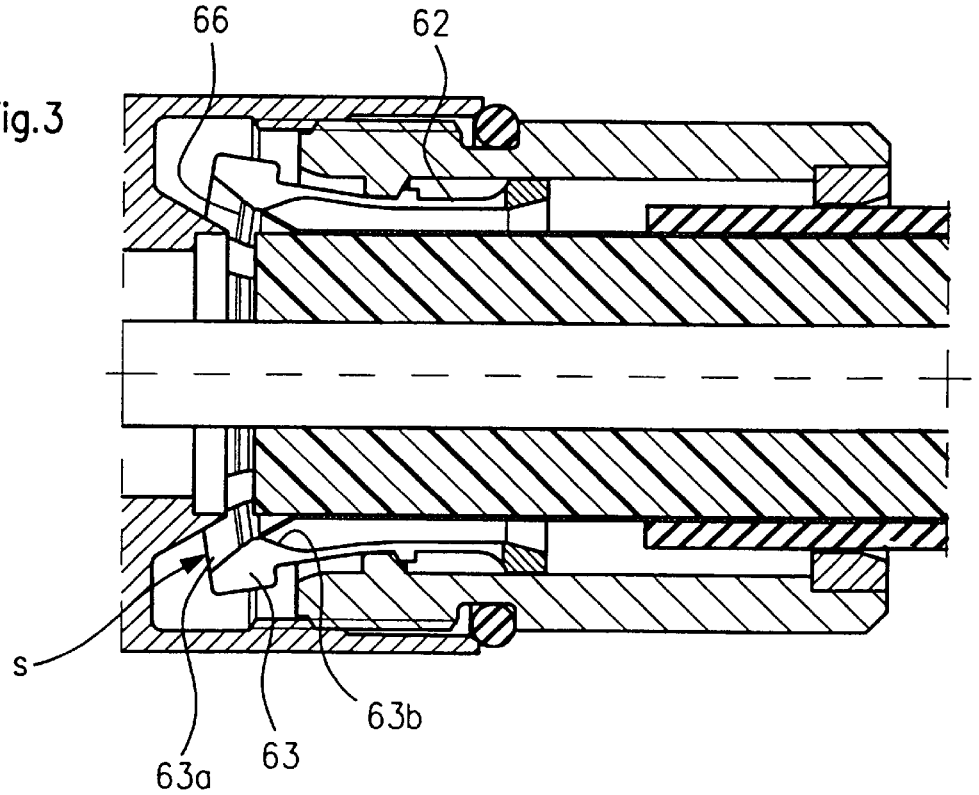
FIG. 3 is a sectional view of the connector of FIG. 2 in a first phase of attachment of the connector onto the cable end.

FIG. 3 shows a next phase of the installation, with the connector being further slipped over the coaxial cable (or vice versa). In this phase, the resilient segments 62 of the contact sleeve 6 are pushed apart, as a consequence of the suitably selected cone angle of the beveled ring surface 63*b*, by the advancing front edge of the end zone 32 of the outer cable conductor 3 to thereby further open the gap s.

Figure 4:
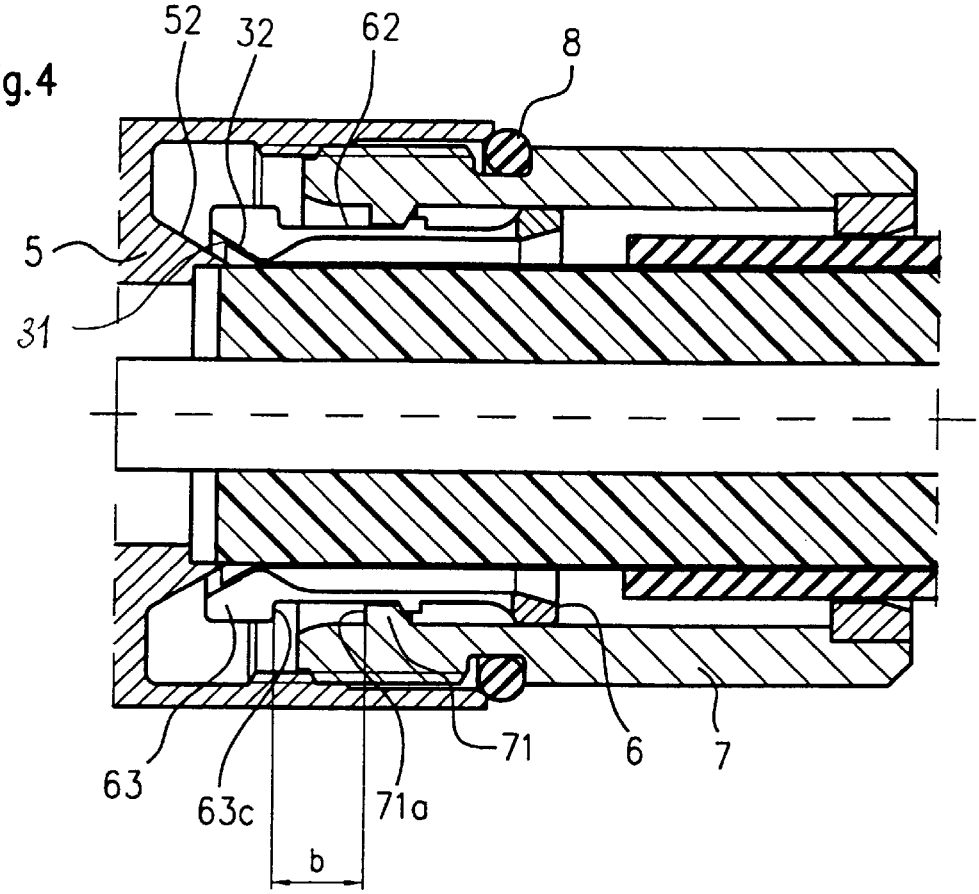
FIG. 4 is a sectional view of the connector of FIG. 2 in a subsequent phase of attachment onto the cable end.

Immediately thereafter, i.e. once the end zone 32 is moved past the beveled ring surface 63*b*, the segments 62 rebound so that the end zone 32 of the outer cable conductor 3 rests on the beaded end 63 of the segments 62, as shown in FIG. 4, and ultimately bears against the beveled ring surface 52 of the connector head 5, when the connector and the coaxial cable are further pushed together.

Figure 5:
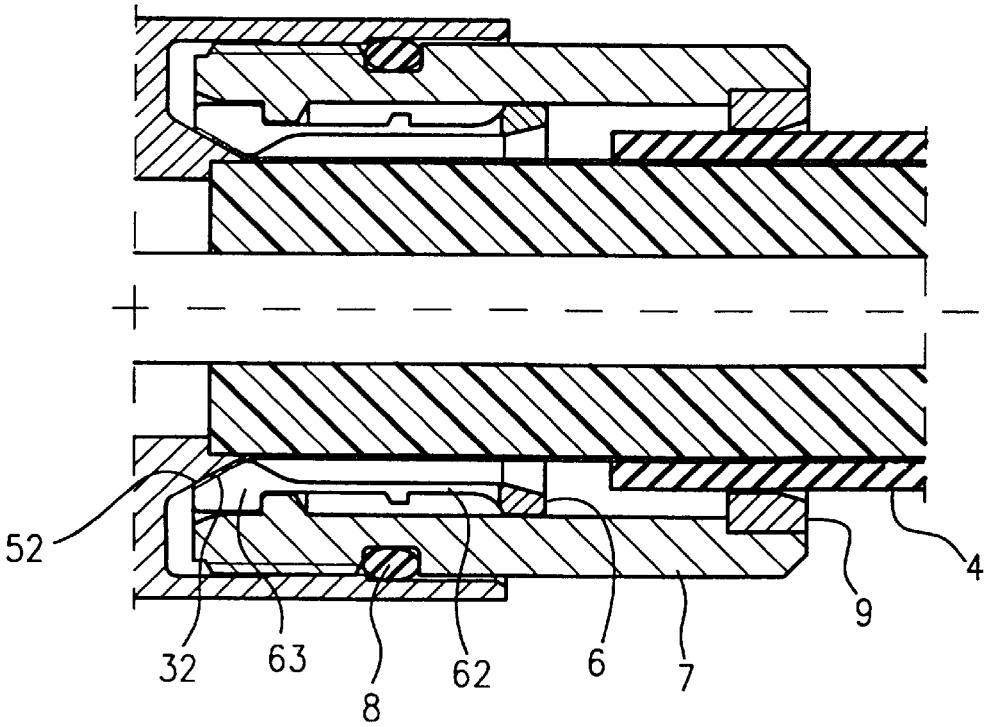
FIG. 5 is a sectional view of the connector of FIG. 2, illustrating the fully assembled connector.

Subsequently, the hollow screw 7 is rotated into the connector head 5 in opposition to the resistance applied by the O ring 8 which thereby deforms. The contact sleeve 6 can thereby travel in axial direction along the clamping path section b which is equal to the distance of the connector head proximal end face 71*a* of the ring shoulder 71 of the hollow screw 7 from a confronting end face 63*c* of the beaded ends 63 of the segments 62 of the contact sleeve 6. During rotation into the connector head 5, the hollow screw 7 ultimately catches the contact sleeve 6 to move it conjointly so that clamping forces and contacting forces are transmitted via the interacting surfaces 71*a*, 63*c* onto the beaded ends 63 of the segments 62 of the contact sleeve 6. Thus, the contact sleeve 6 presses the outwardly deflected end zone 32, like a collet, against the beveled ring surface 52. This situation is shown in FIG. 5 and represents the fully assembled connector.

As further shown in the drawing, a metal ring 9 may be press-fitted in the hollow screw 7 at the connector head distal end thereof to reduce the clear inside diameter of the hollow screw 7 to approximately the outer diameter of the cable, including its cable sheath 4, and to thereby position the hollow screw 7 in proper alignment with respect to the contact sleeve 6. The metal ring 9 is capable of absorbing bending forces acting on the cable, which are thus, at least to a significant extent, removed from the contact-making zone, i.e. from the end zone 32 of the outer cable conductor 3, which is clamped between the ring surface 52 and the beveled ring surface 63*a*. The metal ring 9 is suitably flared outwards at the cable-confronting end to facilitate attachment of the hollow screw 7 to the cable. Persons skilled in the art will appreciate that attachment of a shrinkable hose is certainly also possible in order to realize a tight connection between the cable and the connector. This, however, is not part of the invention and thus not shown in the drawing for the sake of simplicity.

While the invention has been illustrated and described as embodied in a connector for a coaxial cable with smooth outer cable conductor, it is not intended to be limited to the details shown since various modifications and structural changes may be made without departing in any way from the spirit of the present invention.

What is claimed as new and desired to be protected by letters patent is set forth in the appended claims.

What is claimed is:

1. A connector for attachment to a coaxial cable having a smooth outer cable conductor, said connector comprising:

a connector head including a threaded portion and defining a ring surface for establishing a contact from inside with an outwardly deflected end zone of an outer cable conductor;

a contact sleeve adapted to fit over the outer cable conductor and having a plurality of radially resilient segments terminating in beaded ends, said contact sleeve, when not subject to a load, has an inner diameter which in the area of the beaded ends of the segments is smaller than a diameter of the outwardly deflected end zone of the outer cable conductor and in the remaining area is greater than the diameter of the outwardly deflected end zone of the outer cable conductor;

a hollow screw adapted to fit over the contact sleeve and formed with a thread for threaded engagement with the connector head, said hollow screw, after moving a clamping path, loading the segments of the contact sleeve in a direction of a clamping action so that the segments clamp the end zone of the outer cable conductor against the ring surface of the connector head; and indexing means for subdividing the clamping path of the hollow screw into first and second sections, with the first section corresponding to a preassembled state of the connector, and with the second section corresponding to a final assembly of the connector onto the cable.

2. The connector of claim 1 wherein the beaded ends of the segments of the contact sleeve define ramp surfaces formed respectively on a peripheral conical surface area for interaction with an axial end of the end zone of the outer cable conductor, whereby the conical surface area is defined by a cone angle which is so selected that the segments deflect radially outwards when an axial force, applied by the axial end of the outer cable conductor upon the ramp surfaces of the beaded ends, is exceeded.

3. The connector of claim 1 wherein the end zone of the outer cable conductor is clamped between a clamping surface of the segments and the ring surface of the connector head, at least one of the clamping surface and ring surface being provided with at least one bead for improving the clamping action and contact-making capability.

4. The connector of claim 1 wherein the indexing means includes an O ring which is received in an annular groove so positioned that the O ring engages a confronting end face of the connector head at the end of the first section and is moved conjointly with the hollow screw when the hollow screw travels along the second section.

5. The connector of claim 4 wherein the connector head has a cable-proximal end formed with a recess, wherein the hollow screw has an axial end confronting the connector head, said hollow screw having a portion extending axially inwardly of the annular groove and having a length which is at least equal to a length of the second section of the clamping path, said portion of the hollow screw being defined by an outer diameter which is smaller than an inner diameter of the recess of the connector head.

6. The connector of claim 1 wherein the contact sleeve has a ring collar, said hollow screw having interiorly a radially inwardly projecting shoulder which forms a stop for the ring collar of the contact sleeve and so limits a displacement of the contact sleeve in the pre-assembled state of the connector that a gap is defined between the ring surface of the connector head and the segments of the contact sleeve for insertion of the end zone of the outer cable conductor.

7. The connector of claim 6 wherein the shoulder of the hollow screw is a ring shoulder having a connector head confronting end face which transmits at the end of the second section of the clamping path a clamping force onto confronting surfaces of the beaded ends of the segments of the contact sleeve.

* * * * *